United States Patent [19]

Bergmans

[11] Patent Number: 4,505,055

[45] Date of Patent: Mar. 19, 1985

[54] SHOE HAVING AN IMPROVED ATTACHMENT OF THE UPPER TO THE SOLE

[75] Inventor: Charles Bergmans, Sprang Capelle, Netherlands

[73] Assignee: Clarks of England, Inc., Kennett Square, Pa.

[21] Appl. No.: 426,271

[22] Filed: Sep. 29, 1982

[51] Int. Cl.[3] ..... A43B 9/02; A43B 13/28

[52] U.S. Cl. ..... 36/18; 36/12; 12/142 C

[58] Field of Search ..... 36/12, 18, 17, 19, 19.5, 36/22, 11; 12/142 B, 142 C, 142 D, 142 T

[56] References Cited

U.S. PATENT DOCUMENTS

| | | | |
|---|---|---|---|
| 106,012 | 8/1870 | Wickersham | 36/18 |
| 1,425,518 | 8/1922 | Ferguson | 36/18 |
| 1,756,169 | 4/1930 | Benda | 36/19 R |
| 4,034,431 | 7/1977 | Fukuoka | 36/11 |

FOREIGN PATENT DOCUMENTS

| | | | |
|---|---|---|---|
| 751318 | 8/1933 | France | 36/12 |
| 804778 | 11/1936 | France | 12/142 C |
| 1110738 | 2/1956 | France | 36/12 |

*Primary Examiner*—Werner H. Schroeder
*Assistant Examiner*—Steven N. Meyers
*Attorney, Agent, or Firm*—St. Onge, Steward, Johnston & Reens

[57] ABSTRACT

A structure for a shoe which comprises a sole having a lip which extends upwardly from the foot engaging portion of the sole. Outside the lip is a ledge portion. The lip and ledge portion combine to fasten and support the upper to the sole by securement means. The combination is such that the width of the upper and ledge are equal resulting in that the outer portions of the upper and sole are flush. A liner is provided for the upper which engages the inner portion of the sole lip.

12 Claims, 9 Drawing Figures

Fig. 5.
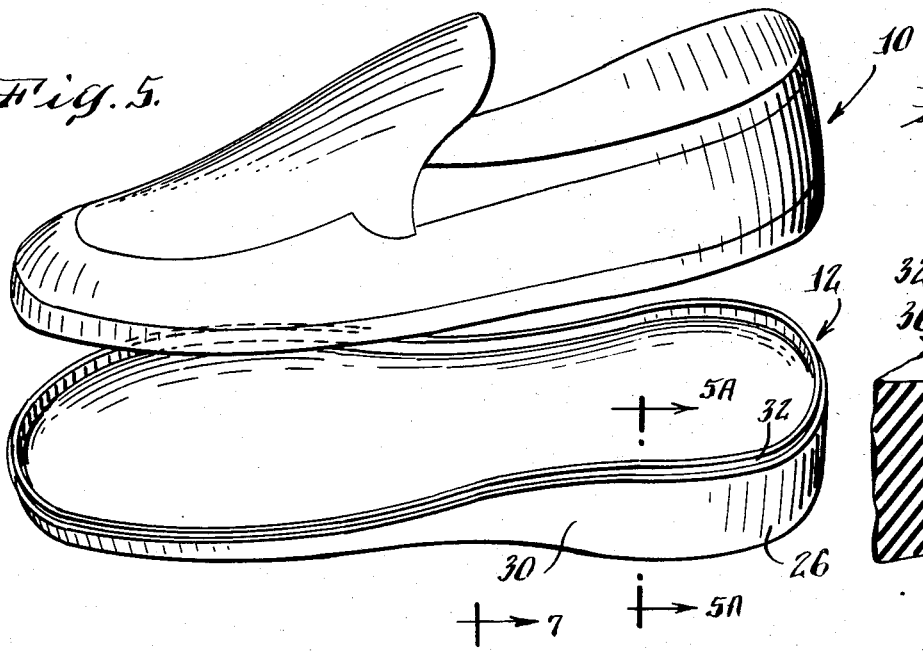
Fig. 5A.
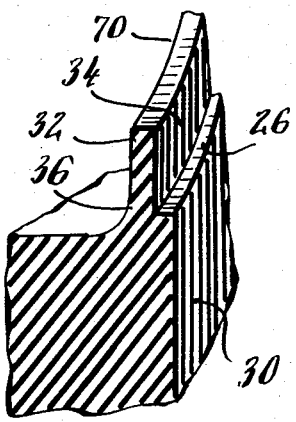
Fig. 6.
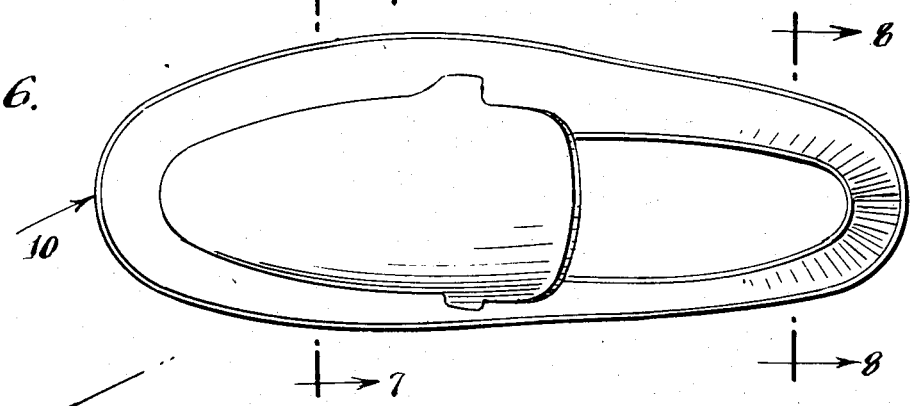
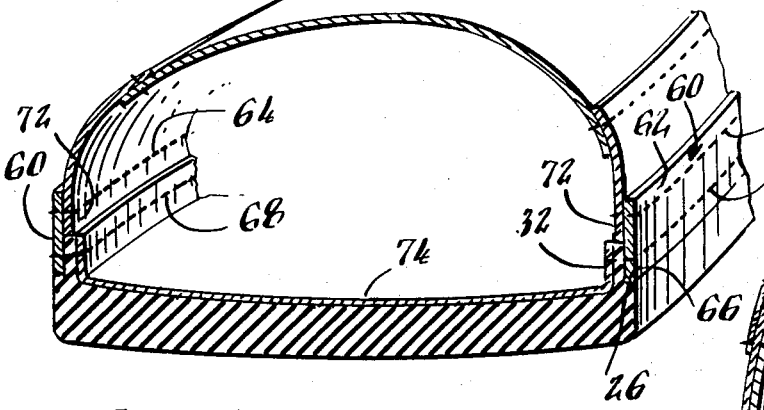
Fig. 7.
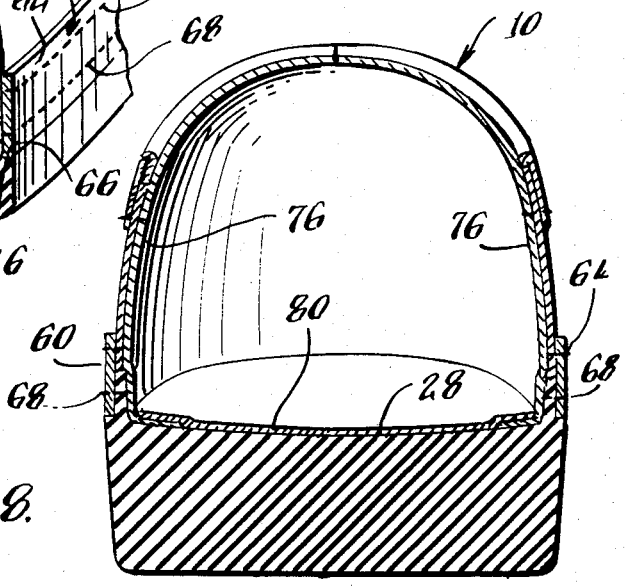
Fig. 8.

SHOE HAVING AN IMPROVED ATTACHMENT OF THE UPPER TO THE SOLE

BACKGROUND OF THE INVENTION (1) Field of the Invention

The present invention relates to shoes, and more particularly, the present invention relates to a shoe having an improved system for attaching the upper of the shoe to its sole.

(2) Description of the Prior Art

A conventional shoe includes an upper that is made of leather, simulated leather or other sheet material. The upper is attached to the sole of the shoe by various conventional methods. Many of the conventional methods have the disadvantage that a substantial amount of leather is used in securing the upper to the sole. For example, in one type of construction, the upper extends generally vertically downwardly to the sole of the shoe, and then is directed horizontally outwardly along the upper surface of the sole of the shoe. The horizontal portion of the upper is stitched to the sole, and then the surplus leather overhanging the sole is trimmed away, resulting in substantial quantities of scrap leather. In another method for attaching the upper to the sole, the leather upper extends generally vertically downwardly to the sole and then is directed horizontally inwardly. The horizontally inwardly extending portion of the upper is then attached to the sole by stitching or an adhesive. With either of the aforementioned conventional methods, and with numerous other known methods for attaching the upper to the sole, substantial amounts of scrap leather is produced. Moreover, many of the prior art systems require skilled workers to align and shape the leather upper so that it is in a position to be attached by stitching or other means to the sole.

It is an object of the invention to provide a shoe having an improved attachment of the upper to the sole. More particularly, it is desired that the improved attachment result in savings of approximately ten to twenty percent or more of leather or other material used for the upper. The amount of savings will depend upon the shoe to which a shoe of the present invention is compared. Moreover, it is an object of the present invention to provide a shoe construction that reduces the amount of trimming and finishing to produce an esthetically pleasing shoe. Further, it is an object of the invention to provide a shoe that can be manufactured by persons having less skill and training than the skill of persons required to assemble prior art shoes.

SUMMARY OF THE INVENTION

In accordance with the present invention, a shoe having an improved construction for attaching the upper of the shoe to its sole is provided. The shoe comprises an upper made of leather, simulated leather or other shoe material. The upper includes a heel portion, a toe portion and side portions including at the bottom thereof a wall extending about the lower periphery of the upper. The wall has an interior surface and a terminal edge at the bottom thereof. The shoe includes a sole, preferably formed from a molded polymeric material such as polyurethane, having an upper surface for supporting the human foot. The sole has a sidewall extending about its circumference and includes a lip projecting generally vertically upwardly from the upper surface of the sole. The lip includes a generally vertical outer face and a base adjacent the upper surface of the sole from which the lip projects from the upper surface of the sole. A ledge projects generally horizontally outwardly from the lip base, the ledge preferably intersecting at right angles with the generally vertical sidewalls of the sole. The lip extends about at least a portion of the circumference of the sole, and, preferably extends about substantially the entire circumference of the sole.

To attach the upper to the sole, the terminal edge of the upper is positioned in abutting relation with the ledge and the interior surface of the wall of the upper is positioned in face-to-face relation with the vertical face of the lip. The upper is secured to the sole by stitching which extends through the wall and the lip. In accordance with one aspect of the invention, the lip and the ledge extend around substantially the entire circumference of the sole. When the upper is being attached to the sole, the ledge provides a guide for enabling precise positioning of the upper with respect to the sole by a relatively unskilled person. More particularly, the person assembling the upper and the sole simply places the terminal edge of the upper in abutting relation with the ledge and stitches the upper to the lip of the sole. Because the terminal edge of the upper is placed in abutting relation with the ledge, trimming of excess material is avoided. Moreover, since the bottom wall of the upper is neither turned inwardly or outwardly to enable downward stitching or other means of attachment with respect to the sole, a significant amount of leather savings are achieved in cutting the various portions of the upper from sheet material. When the savings due to substantial avoidance of trimming as well as reduced amounts of material used to attach the upper to the sole are accounted for, the savings in material used for the upper can be as much as ten to twenty percent or more, depending upon a particular type of shoe to which the shoe of the present invention is compared.

Moreover, since the ledge acts as a guide to enable a relatively unskilled worker to assemble the shoe, the shoe is relatively inexpensive to manufacture in that less skilled labor may be used and the shoe may be assembled in less time. Moreover, since the terminal edge of the upper abuts the ledge, and is not in view from the exterior of the shoe, the terminal edge of the upper does not require finishing, as may be necessary in various types of prior art shoes.

In accordance with one aspect of the invention, the ledge has a depth that is substantially equal to the thickness of the bottom wall of the upper so that when the upper and the sole are assembled, the exterior surface of the upper is flush with the sole sidewall. The flush relationship between the exterior surface of the upper and the sole sidewall provides an esthetically pleasing appearance for the shoe.

In accordance with another aspect of the invention, the shoe further includes an insole for lining the shoe. The insole has a portion that extends generally vertically upwardly in face-to-face relation with the inner surface of the lip. When the wall of the upper and the lip are stitched together, the same stitching also secures the insole to the lip. As can be appreciated, a shoe having an insole in accordance with the above described embodiment of the invention is relatively inexpensive to manufacture in that the insole and the upper are attached to the sole in a single stitching operation.

Additional advantages of a shoe in accordance with the present invention will be apparent from the drawings and the detailed description of the drawings that follow.

BRIEF DESCRIPTION OF THE DRAWINGS

FIG. 5 is a perspective exploded view of another embodiment of a shoe prior to the upper being assembled with the sole;

FIG. 5A is an enlarged sectional and perspective view of the lip and the sole;

FIG. 6 is a top plan view of the shoe shown in FIG. 5 after it has been assembled;

FIG. 7 is a sectional and perspective view along the plane 7—7 of the shoe shown in FIG. 6;

FIG. 8 is a sectional view along the plane 8—8 of the shoe shown in FIG. 6.

DETAILED DESCRIPTION OF THE INVENTION

Figure 1:
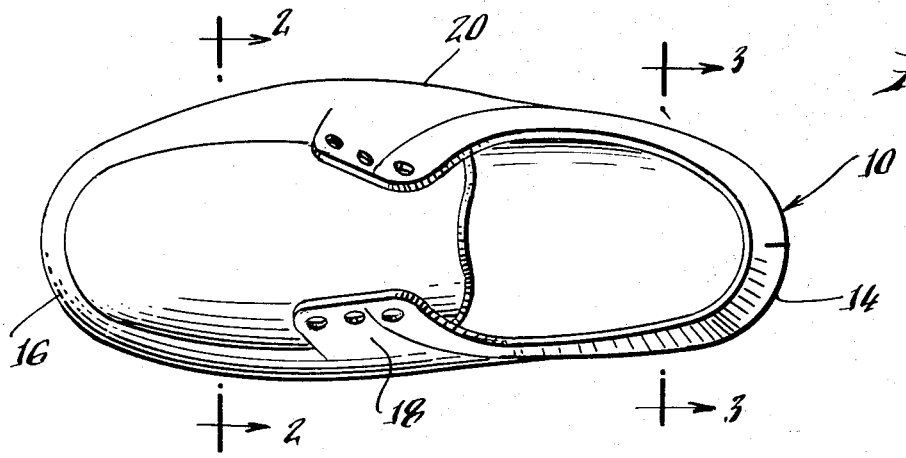
FIG. 1 is an upper plan view of one embodiment of a shoe in accordance with the present invention.

Referring in particular to FIGS. 1 and 5, which show two different embodiments of a shoe, a shoe in accordance with the present invention includes an upper 10 and a sole 12. The upper is made from leather, simulated leather or other sheet material for making shoe uppers. As can be appreciated from comparing FIGS. 1 and 5, the upper of the shoe in accordance with the present invention can have numerous types of styles and, for example, may be a laced shoe as shown in FIG. 1 or a loafer as shown in FIG. 5.

Figure 2:
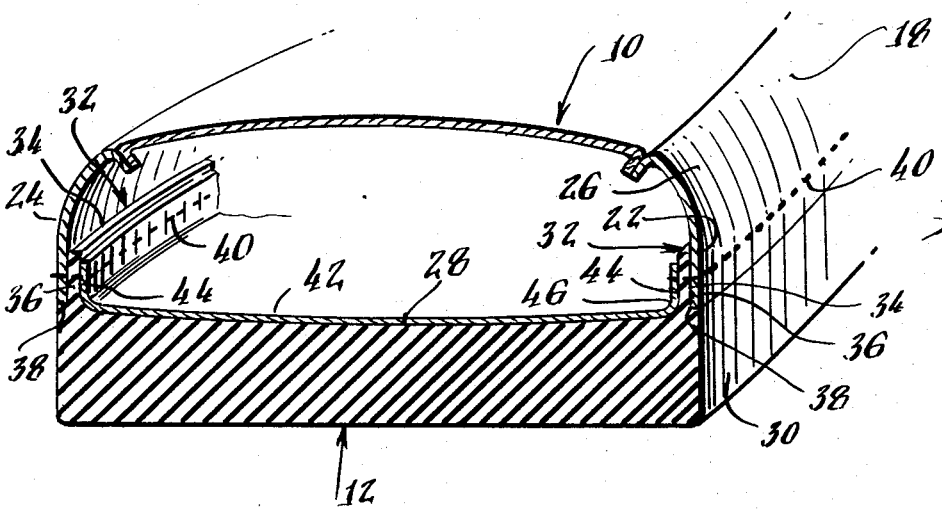
FIG. 2 is a sectional and perspective view along the plane 2—2 of the shoe shown in FIG. 1.
Figure 4:
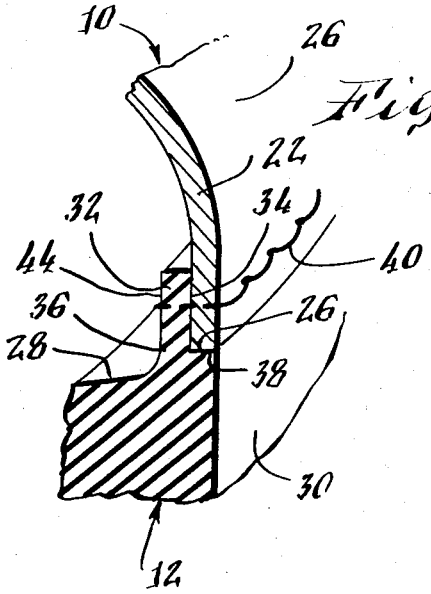
FIG. 4 is an enlarged sectional and perspective view of the system for attaching the bottom wall of the upper to the sole of the shoe.

Referring to FIGS. 1–4 and in particular FIGS. 2 and 4, the upper 10 includes a heel portion 14, a toe portion 16 and side portions 18 and 20. The heel, toe and side portions include at the bottom thereof a wall 22 (see FIGS. 2 and 4). The wall 22 preferably extends about the periphery of the upper 10 as shown particularly well in the left hand portion of FIG. 2 as well as FIG. 4. The wall 22 includes an interior surface 24 and a terminal edge 26. Terminal edge 26 as well as the interior surface 24 of the wall preferably extend substantially around the entire periphery of the upper. The wall 22 also includes an exterior surface that is typically finished, whereas the interior surface 24 and the terminal edge 26 need not be finished because it is not in view when the shoe is assembled.

Referring to FIGS. 2 and 4, the construction of the sole will now be described. The sole 12 has an upper surface 28 for supporting a human foot. The sole has a sidewall 30 which extends about its circumference. A lip 32 projects generally vertically upwardly from the upper surface 28. The lip 32 includes a generally vertical outer face 34 and a base 36 adjacent the upper surface 28 of the sole 12. A ledge 38 projects generally horizontally outwardly from the base 36 of the lip. As shown particularly well in FIG. 4, the terminal edge 26 of the upper 10 abuts the ledge 38. The interior surface 24 of the wall 22 is in face-to-face relation with the vertical face 34 of the lip. Stitching 40 extends through the wall 22 of the upper and the lip 32 to thereby secure the upper 10 to the sole 12. Preferably, the ledge 26 and the lip 32 extend substantially the entire circumference of the sole. When the upper 10 is being attached to the sole 12, the ledge 26 provides a guide for enabling precise positioning of the upper with respect to the sole. The person assembling the shoe simply places the terminal edge of the upper 26 in abutting relation with the ledge 38 and stitches the upper to the lip as shown by stitching 40. Because the terminal edge of the upper 26 abuts the ledge 38, it is out of view and therefore finishing is unnecessary. Further, trimming of excess material is avoided.

In accordance with another aspect of the invention, the shoe is provided with an insole 42. Referring in particular to FIG. 2, lip 32 includes a generally vertical inner face 44. At least a portion of the upper surface 28 of the sole 12 is lined with the insole 42. The insole includes a generally vertical portion 46 which is positioned in face-to-face relation with the inner face of the lip 32. When the upper 10 is stitched to the sole 12 by stitching 40, the stitching extends through the insole 42 as shown in the lefthand portion of FIG. 2. Thus, a single stitch not only secures the upper to the sole, but also secures the insole to the lip of the sole, thereby simplifying and expediting the manufacture of the shoe. The insole may line a portion of the upper surface 28 of the sole 12, or may line the entire surface 28. In the shoe shown in FIGS. 1 through 3, the insole 42 extends only in the front portion of the shoe.

Figure 3:
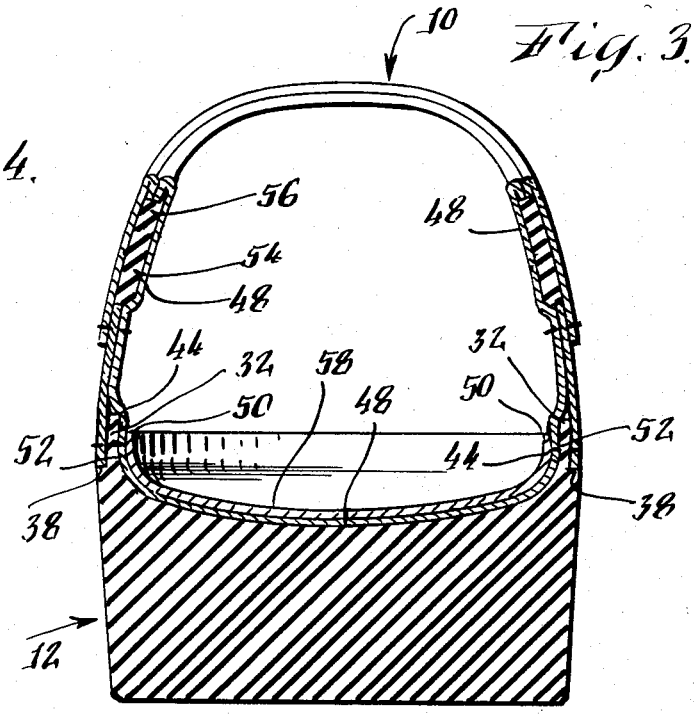
FIG. 3 is a sectional view along the plane 3—3 of the shoe shown in FIG. 1.

The heel portion of the shoe is shown in FIG. 3. The upper in the region of the heel includes a liner for lining the inside of the shoe, the liner including at the bottom thereof a wall 50 having an inner surface 52 that is positioned in face-to-face relation with a generally vertical inner face 44 of the lip 32. When the upper is secured to the sole by use of stitching 40, the stitching in the region of the heel not only secures the upper 10 to the sole but also secures the liner 48 to the lip of the sole.

As shown particularly well in FIG. 3, the upper of a shoe in accordance with the present invention may have various designs. For example, the shoe shown in FIG. 3 has a padded heel portion including a foam strip 54 secured in a space 56 between the upper 10 and the liner 48. Also as shown in FIG. 3, in addition to a liner 48 the heel portion of the shoe may also include an insole 58 adhered to liner 48.

Referring to FIGS. 5–8, another embodiment of a shoe in accordance with the present invention will now be described. It should be understood that sole 12 shown in FIG. 5 is identical to the sole shown in FIGS. 1–4, and like reference numerals will be applied to like elements. In the embodiment shown in FIGS. 5–8, the appearance of the shoe is a loafer having an esthetically pleasing band that extends about the circumference of the upper. The band 60 includes a top portion 62 that is secured to the upper by stitching 64. The band 60 includes a lower portion having a terminal edge 66 that abuts the ledge 26 of the sole. The band is secured to the sole by stitching 68 which extends through the lip 32 of the sole 12. As best shown in FIG. 5A, the lip has a top edge 70 which abuts the terminal edge 72 of the upper. As shown in FIG. 7, the shoe includes an insole 74 in the front portion thereof which is secured to the lip 32 by stitching 68. As shown in FIG. 8, the heel portion of the shoe includes a liner 76 which is secured to the lip by stitching 68. The heel portion may also include an insole 80 which is secured to the upper surface 28 of sole 12 by any suitable means such as, for example, an adhesive.

A shoe in accordance with the present invention is particularly simple to construct in that a relatively unskilled person may simply abut the ledge of the sole with the terminal edge of the upper and sew stitching through the upper into the adjacent lip. A shoe in accordance with the present invention reduces or eliminates trimming of the leather, and in addition reduces the total quantity of leather necessary for the shoe. Since the terminal edge of the upper is abutting the ledge and is out of plain view, there is no necessity to finish the terminal edge of the upper. In addition to securing the upper to the sole, the lip may serve as a means for securing the interior portions of the shoe, that is, the insole and the lining, to the sole.

In accordance with one aspect of the invention, the lip is integral with the upper surface, and the sole and the lip are formed from a molded polymeric material, such as, for example, foam polyurethane. It should be understood that various other types of polymeric materials may be used.

In accordance with one aspect of the invention, the ledge has a depth and the wall of the upper has a thickness substantially equal to the ledge depth so that when the shoe is assembled the exterior surface of the upper is flush with the sidewall of the sole to thereby provide an esthetically pleasing appearance for the shoe.

It should be understood that although specific embodiments of the invention have been described herein in detail, such description is for purposes of illustration only and modifications may be made thereto by those skilled in the art within the scope of the invention.

I claim:

1. A shoe for a human foot comprising:

an upper including a heel portion, a toe portion and side portion, said heel, toe and side portions including at the bottom thereof a wall extending about the periphery of said upper, said upper comprising sheet material having a thickness, said wall having an interior surface and a terminal edge, said terminal edge having a thickness substantially equal to the thickness of said sheet material;

a sole having a generally horizontal upper surface for supporting said human foot, said sole having a sidewall extending about its circumference;

a lip projecting generally vertically upwardly from said upper surface, said lip including a generally vertical outer face and a generally vertical inner face, said inner face smoothly converging with said upper surface of said sole, said lip projecting upwardly from said upper surface a distance to provide lateral support for said foot, and said lip including a base;

a ledge projecting generally horizontally outwardly from said lip base, said terminal edge of said wall abutting said ledge and said interior surface of said wall being in face-to-face relation with said vertical face of said lip;

means extending through said wall and said lip for securing said upper to said sole; and a liner for at least a part of said upper, said liner having at the bottom thereof a wall having an inner surface, said inner surface being in face-to-face relation with said generally vertical inner face of said lip, said means for securing including means extending through said lip said wall and said liner to secure the liner and the wall to the sole said edge having a depth and said terminal edge having a thickness substantially equal to said ledge depth to provide an upper that is substantially flush with said sole sidewall.

2. A shoe according to claim 1, said lip being integral with said upper surface.

3. A shoe according to claim 2, said sole and said lip comprising a molded polymeric material.

4. A shoe according to claim 3, said polymeric material comprising foamed polyurethane.

5. A shoe according to claim 1 wherein said lip extends about substantially the entire circumference of said sole.

6. A shoe according to claim 5 wherein said means comprises stitching extending through said wall and said lip, said stitching extending substantially about the entire circumference of said sole.

7. A shoe according to claim 1 wherein said lip includes a generally vertical inner face and wherein at least a portion of said upper surface of said sole being lined by an insole, said insole having a portion being in face-to-face relation with said inner face, said means for securing including means extending through said portion of said insole and said lip for securing said insole to said sole.

8. A shoe according to claim 7 wherein said securing means comprises stitching extending through said wall, said lip and said insole.

9. A shoe according to claim 1 wherein said wall comprises a band extending about the circumference of said upper, said band including a top secured to said upper by stitching and said terminal edge of said upper being located at the bottom of said band, said upper having a distal edge located adjacent the band top, said lip extending about substantially the entire circumference of said sole, said lip having a top edge abutting said distal edge of said upper.

10. A shoe according to claim 1 wherein said lip extends about substantially the entire circumference of said sole and wherein said upper surface of said sole includes a section bounded by said lip, said section being generally concave and being shaped to conform to said human foot.

11. A shoe according to claim 10 wherein said sole and said lip comprises a molded polymeric material.

12. A shoe according to claim 1 wherein said ledge and said sidewall of said shoe intersect in a substantially perpendicular relation to each other.

* * * * *